United States Patent [19]

Whitley et al.

[11] Patent Number: 4,527,629

[45] Date of Patent: Jul. 9, 1985

[54] PRESSURE DIFFERENTIAL CIRCULATING VALVE

[76] Inventors: Oran D. Whitley, 1506 N. Colpitts; James B. Poque, Rte. 1, Box 78-A, both of Ft. Stockton, Tex. 79735

[21] Appl. No.: 432,582

[22] Filed: Oct. 4, 1982

[51] Int. Cl.[3] ..... E21B 34/08

[52] U.S. Cl. ..... 166/321; 166/325

[58] Field of Search ..... 166/319, 321, 325, 327, 166/320; 175/243, 317; 251/343, 363, 360, 359; 137/538, 508

[56] References Cited

U.S. PATENT DOCUMENTS

| | | | |
|---|---|---|---|
| 1,856,138 | 5/1932 | Ruemelin | 251/359 X |
| 3,871,450 | 3/1975 | Jett et al. | 166/319 |
| 4,257,484 | 3/1981 | Whitley | 166/325 |
| 4,315,616 | 2/1982 | Welker | 251/363 X |
| 4,391,328 | 7/1983 | Aumann | 166/321 X |

FOREIGN PATENT DOCUMENTS

| | | | |
|---|---|---|---|
| 1070464 | 12/1959 | Fed. Rep. of Germany | 251/363 |

*Primary Examiner*—Stephen J. Novosad
*Assistant Examiner*—Thuy M. Bui
*Attorney, Agent, or Firm*—Fulbright & Jaworski

[57] ABSTRACT

Disclosed is an improved pressure differential circulating valve which can be connected to and form a portion of the tubing string disposed in casing for flow of fluid from a formation traversed by the casing and the tubing or for other uses in well bores which has the following improvements: the valve seat is detachable from the main valve body and a seal arrangement is provided so that the valve seat is movable longitudinally and transversely of the body effective to align the valve seat with the valve sleeve seating surface to form a complete 360 degree seat; the detachable valve seat permits the use of different metal alloys or other materials on the main valve seating surface to withstand various conditions of use; the throat area has been opened which increases the hydraulic lifting forces of the valve sleeve thereby permitting lower treating pressures; and a manifold area is provided which uniformly distributes fluid from the ports in the body causing the downhole differential circulating valve to snap open instantly on a 360 degree basis. In addition, a bellows type spring is utilized which seals the downhole differential circulating valve faster and more uniformly than our original pressure differential circulating valve.

11 Claims, 4 Drawing Figures

PRESSURE DIFFERENTIAL CIRCULATING VALVE

BACKGROUND OF THE INVENTION

1. Field of the Invention

The present invention relates to circulating valves for use in oil wells.

2. Prior Art

There have been a number of proposals for providing bypass or circulating valves for use in oil wells. For example, U.S. Pat. No. 3,500,911 discloses a device which has an internally mounted valve sleeve 50 which opens and uncovers the port 64 while the string is being run to the depth of the formation in response to the hydrostatic pressure of the well fluid. The valve 50 closes when the pressure reaches a certain minimum value and is for use with packers for open hole drill stem testing of wells.

U.S. Pat. No. 3,542,130 discloses a valve for removing paraffin from oil wells in which there is a spring loaded sleeve with a restriction in the sleeve that is used to hold a wax plug to close off the sleeve allowing it to move downwardly so that hot oil may pass out through the port 68. The hot oil dissolves wax in the string and flows back up through the pipe and carries the then melted wax plug along with the paraffin in the well to the surface.

U.S. Pat. No. 4,049,057 discloses a paraffin cleaner in which there are valves in a unit, which does have an unrestricted passage through it but the unit is eccentrically mounted, utilizes cupped or Belville washers, and does not circulate treating fluid out of the cleaner about a circumference of 360 degrees.

U.S. Pat. No. 3,376,936 discloses a bypass for removing paraffin in which a sliding sleeve arrangement is operated from the surface to uncover ports to allow the hot oil to pass out of the oil string.

U.S. Pat. No. 4,257,484, but none of the foregoing patents, discloses a pressure differential circulating valve which becomes an integral part of the tubing string, is of small enough external diameter so that it can be readily disposed in a normal casing string in the well bore and yet have an unrestricted passageway through it of substantially the same size and shape as of the tubing string, which can be set to open at any desired pressure, and which is opened by applying flow pressure to the tubing, such as from the surface, so that fluid, such as hot oil or other treating fluid, can circulate down through the tubing and out 360 degrees through the pressure differential circulating valve, and when the treatment is completed, the pressure differential circulating valve automatically closes for resumption of normal operations, such as pumping oil by sucker rods extending through the passageways in the tubing and in the pressure differential circulating tool to the surface.

SUMMARY OF THE INVENTION

The present invention is directed to improvements of the pressure differential circulating valve of U.S. Pat. No. 4,257,484 (our original pressure differential circulating valve) and has all of the advantages thereof as well as the improvements of the present invention.

In summary, these improvements comprise a valve seat which is detachably connected to the main valve body and includes a sealing arrangement which permits a limited oscillating or universal movement of the valve seat, that is both longitudinally and transversely of the body, which functions to align the valve seating surface of the valve seat with the coacting valve seating surface on the valve sleeve which results in a complete 360 degree valve seating.

In providing the valve seat separate and detachable from the body, different metal alloys can be utilized on the main valve seating surface to accommodate various conditions of downhole use of the downhole differential circulating valve.

A further improvement is in providing a greater opening of the throat area of the valve which results in increased hydraulic lifting force of the valve sleeve and thus permitting decreased treating pressures.

A further improvement is the provision of a manifolding area which distributes the fluid from ports in the body uniformly inside the valve sleeve which effectively snaps open the valve sleeve instantly on a 360 degree basis.

A further improvement is the provision of a bellows type spring which permits the elimination of the outer tubular sleeve 44 of our original pressure differential circulating valve.

Accordingly, it is an object of the present invention to provide improvements to our original pressure differential circulating valve of U.S. Pat. No. 4,257,484.

A further object of the present invention is to provide as improvements to such pressure differential circulating valve seal means constructed and arranged to allow the valve seat to move or oscillate longitudinally and transversely of the body thereby insuring complete alignment of the valve seating surface of the valve seat with the coacting valve surface of the valve sleeve to form a complete 360 degree seal.

A further object of the present invention is the improvement of our original pressure differential circulating valve by providing a detachable valve seat from the main valve body so that different metal alloys or other materials on the main valve seating surface can be utilized to withstand the conditions of downhole use.

A further object of the present invention is to provide an improvement to our original pressure differential circulating valve by opening the throat area of the fluid passage, thus increasing the hydraulic lifting force of the valve sleeve thereby permitting decreased treating pressures in opening the valve for treatment purposes.

A further object of the present invention is an improvement to our original downhole differential circulating valve by providing a manifolding area for distributing the fluid from the ports in the body inside the valve sleeve which instantly snaps open the valve on a 360 degree basis.

A further object of the present invention is the provision of an improvement to our original pressure differential circulating valve comprising the use of a bellows type spring which seals the downhole differential circulating valve quicker and more uniformly.

A further object of the present invention is the provision of improvements to our original pressure differential circulating valve in its assembly and disassembly for removal and repair or replacement of parts, as desired.

Other and further objects, features and advantages of the improved pressure differential circulating valve appear throughout.

DESCRIPTION OF PREFERRED EMBODIMENTS

Figure 1:
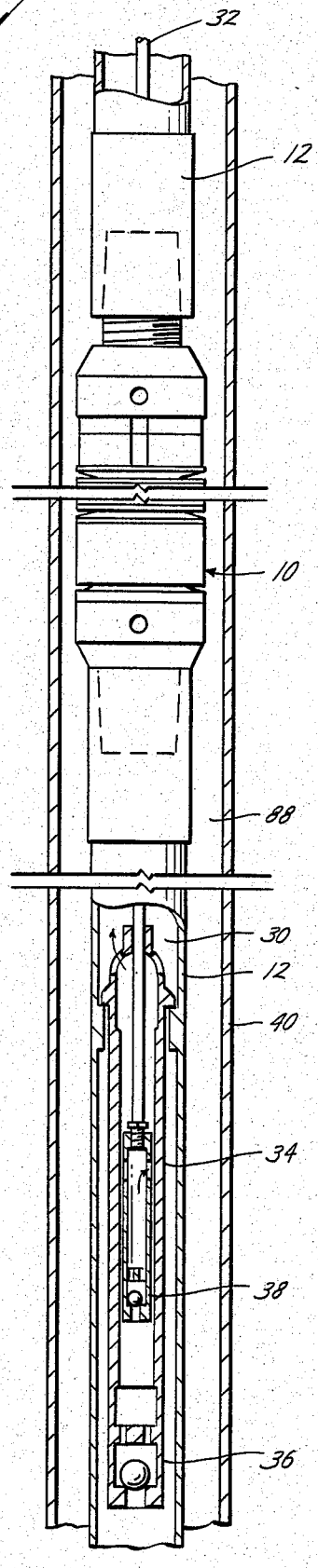
FIG. 1 is a side elevation, partly in section, illustrating the pressure circulating differential valve in position and forming a part of a tubing and casing in a well bore having pumping (sucker) rods therein.
Figure 2:
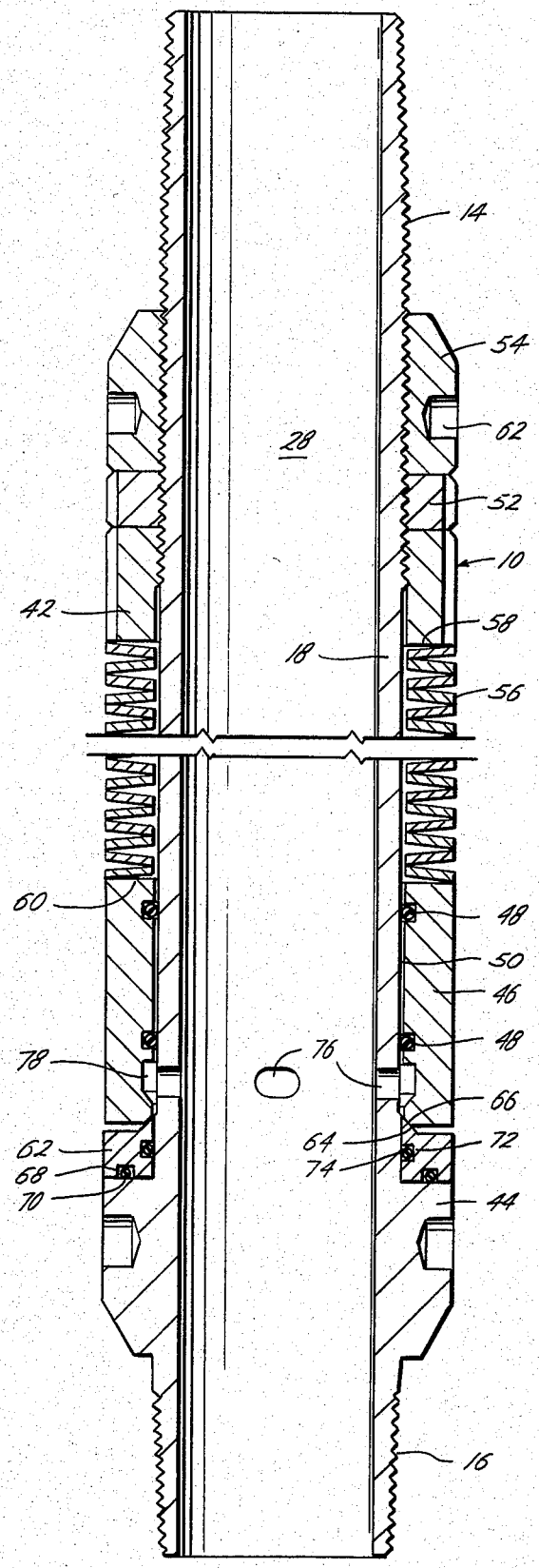
FIG. 2 is an enlarged sectional elevational view of the pressure differential circulating valve illustrated in FIG. 1.

Referring to the drawings, and particularly to FIGS. 1 and 2, the improved pressure differential circulating valve is generally indicated by the reference numeral 10 and is here shown connected in the tubing string 12 by the tubing threads 14 and 16 on the upper and lower ends of the tubular body 18, although the pressure differential circulating valve 10 can be connected into the tubing string or other pipe strings by any desired means.

The passageway 28 is generally of the same internal diameter and shape of the passageway 30 of the tubing string 12 so that there is an unrestricted flow passage of generally the same size and shape through the pressure differential circulating valve 10 as is in the tubing 12. Thus, pump or sucker rods 32 extending from pumping equipment at the surface (not shown) can readily extend through the passageway 28 in the pressure differential circulating valve 10 as well as the pump mechanism 34 attached to the pump rods, including the standing or back pressure valve 36 and the traveling valve 38 which can pass through and be secured in the tubing string to pump fluid from a well traversed by the tubing 12 and the casing 40 in the normal manner without any interference whatsoever with the pumping operation.

No further description is given of the pumping equipment and rods as the improved pressure differential circulating valve 10 can be used in tubing strings with any desired type of pumping equipment, none of which constitutes the present invention.

A pair of longitudinally spaced and facing annular shoulders 42 and 44 are provided on the tubular body 18, the annular shoulder 42 being disposed at the upper end and in the form of a threaded nut for ease of assembly and disassembly, and the annular shoulder 44 being part of the lower end of the body 28.

A tubular slide valve 46 is provided between the annular shoulders 42 and 44 about the tubular body 28 and has the seal means in the form of O-rings 48 associated with it and the outer surface 50 of the tubular body 18 to provide a seal between the slide valve 46 and the tubular body 18.

An annular lock ring 52 is threaded to the threads 14 at the upper end of the tubular body 18 and a top lock ring 54 is similarly threaded to the threads 14 of the body 18 to lock the threaded nut 42 into the desired position.

A bellows type spring 56 is disposed about the tubular body 18 and abuts against the downwardly facing annular shoulder 58 of the threaded nut 42 at its upper end and the upwardly facing shoulder 60 of the tubular valve sleeve 46. The bellows spring 56 is a compression spring which can be set at any desired pressure by construction of the spring and by position of the threaded nut 42. For example, simply screwing the threaded nut 42 toward the valve sleeve 46 increases the compression in the bellows spring 56 to preset a desired higher pressure. Screwing the threaded nut away from the valve sleeve 46 decreases the compression in the bellows spring 56. To assist in screwing the threaded nut 10 to adjust the compression in the bellows spring 56, flats as illustrated are provided on the threaded nut 10 and lock ring 52 and the openings 62 are provided in the lock ring 54 so that a tool having projections fitting therein, such as a spanner wrench, not shown, can be used to screw lock ring 54 to the desired position.

Figure 3:
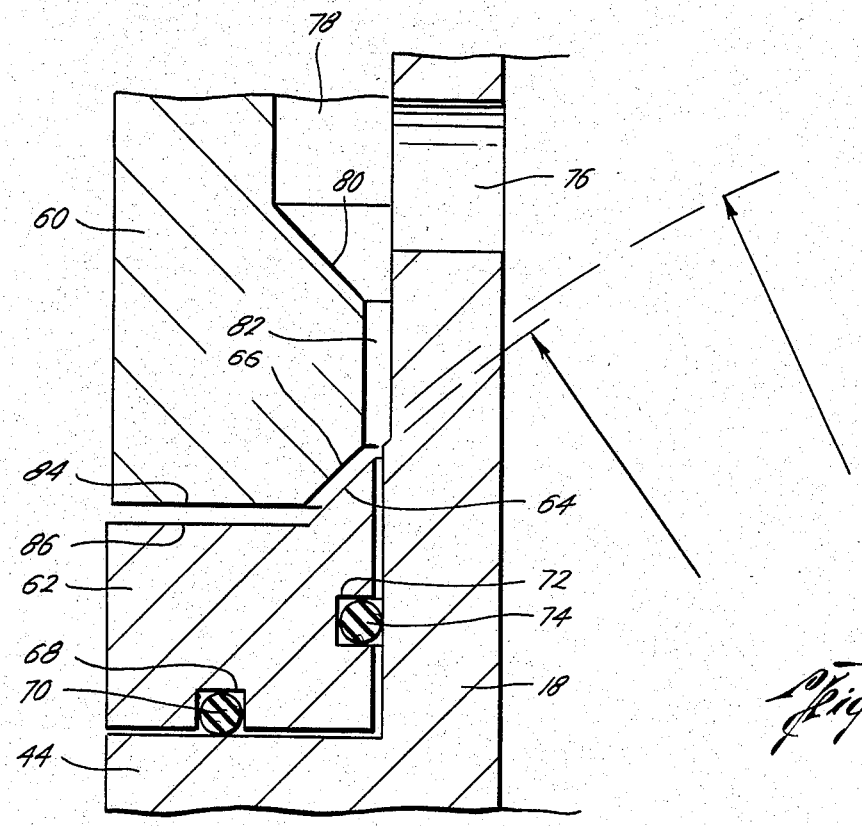
FIG. 3 is an enlarged, fragmentary sectional view illustrating a preferred form of valve seat, shown in a slightly open position for purposes of illustration.

As best illustrated in FIGS. 2 and 3, an annular valve seat 62 is disposed about the tubular body 18 and seats on the shoulder 44. The valve seat 62 is separate and removable from the body 18 and is provided with an annular valve seating surface 64 which is engaged by a coacting or mating annular valve seating surface 66 at the lower end of the sleeve valve 60. Thus, in normal operations the compression spring 56 maintains the valve surface 66 on the slide valve 60 seated against the coacting valve surface 64 on the valve seat 62 thereby providing an effective seal.

To insure that a complete 360 degree seal is provided, a downwardly facing annular grove 68 provided with the O-ring 70 is disposed at the lower end of the valve seat 62 and an inwardly facing annular groove 72 into which is disposed the O-ring 74 is provided in the annular valve seat 62. This sealing arrangement provides an effective seal between the valve seat 62, the body 18 and the shoulder 44 and at the same time provides limited movement longitudinally and transversely of the body 18 thus providing a limited universal or rocking movement which insures complete 360 degree seating of the valve surfaces 64 and 66 on the valve seat 62 and the sleeve valve 60, respectively.

A plurality of ports 76 are disposed in the tubular body 18, here shown as four ports, which open into a manifold in the form of an annular groove 78 disposed in the valve sleeve 60 so that treating fluid flowing through the ports 76 flows into the manifold 78, which extends circumferentially 360 degrees to provide an even distribution of treating fluid. As best seen in FIG. 3 the manifold 78 is tapered inwardly at 80 and a complete circumferential passage 82 is provided at its lower end so that treating fluid flowing through the ports 76 into the manifold 78 flow to and between the valve seating surfaces 66 and between the facing annular shoulder surfaces 84 and 86 of the valve sleeve 60 and the valve seat 62 thereby providing instantaneous snap action opening of the valve sleeve 60 by moving it upwardly against the compression in the bellows spring 56 away from the valve seat 62.

Figure 4:
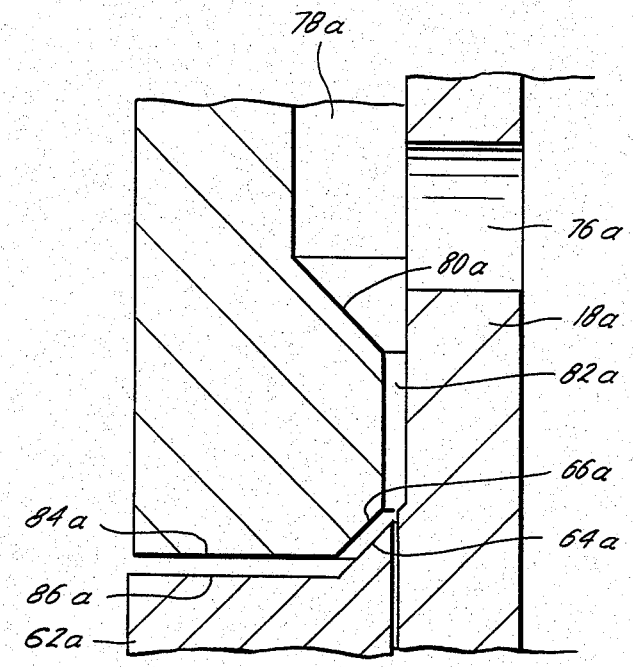
FIG. 4 is a view similar to that of FIG. 3 but illustrating flat seating surfaces, and also shown in a slightly open position for purposes of illustration.

As best seen in FIG. 3, the valve seating surfaces 64 and 66 are spherically shaped which provides a fast and effective seating and sealing of the valve surfaces 64 and 66. While any desired spherical seating can be utilized, a spherical seat formed on a 2.384 radius and having a seat width of 2 degrees of the arc is presently preferred. If desired, however, the valve seating surfaces 64 and 66 can be straight or flat, as illustrated in FIG. 4 in which the reference letter "a" has been added to numerals designating corresponding parts in FIG. 3. Preferably, both forms of sealing surfaces, that is the flat and the spherical, are at a 45 degree angle to the body although other effective sealing angles and shapes can be used.

The pressure differential circulating valve 10 can be assembled simply by placing the detachable valve seat 62 into position, then placing the sleeve valve 46 into position, the bellows type spring 56 into position, and the nut 42 threaded into position for a desired preset pressure of the bellows type spring 56. The locking rings 52 and 54 may then be secured into position and the improved pressure differential circulating valve is ready for use in a tubing or pipe string. In disassembling the tool for replacement and repairs, the procedure is simply reversed. To change the pressure setting on the bellows spring 56 the locking rings 52 and 54 are partially unthreaded (to lessen the compression in the bellows spring 56) and the threaded nut 42 is threaded away from the sleeve valve 46 to the desired preset compression. The locking rings 52 and 54 are then threaded in position as illustrated in FIG. 2. To increase the compression in the spring 56, it is only necessary to thread the threaded nut 42 toward the sleeve valve 46 to the desired position and then thread the locking rings 52 and 54 toward the threated nut 42 into abutting positions as shown in FIG. 2.

In operation, the improved pressure differential circulating valve 10 is simply threaded into the tubing string 12 and becomes a part thereof as shown in FIG. 1. Any oil well equipment which can be passed through the tubing 12, such as the pumping equipment illustrated, can be passed through and operated through the pressure differential circulating valve 10. When it is desired to treat the well, such as removing paraffin from the sucker rods 32, hot oil is pumped down the passageway 30 in the tubing string 12 and when its flow pressure is sufficient to overcome the compression of the bellows spring 56, such as 500 to 4,000 p.s.i., the hot oil flows through the ports 76 into the manifold 78 and then down the passage 82 and between the valve seating surfaces 64 and 66 and the shoulders 84 and 86 thereby causing the slide valve 58 to instantly move away from the valve seat 62, which thus permits the hot oil to flow into the annular space formed between the outer surfaces of the tubing string 12, the pressure differential circulating valve 10 and the casing 40. Thus, when used for removing paraffin deposits, hot oil with melted paraffin flows down the passageways 28 and 30, around the sucker or pump rods 32, melting the paraffin, which melted paraffin and hot oil flows out into the annulus 88 between the casing 40 and the tubing string 12 with the hot oil. Once the treatment has been completed, the pump pressure from the surface, not shown, is stopped, thus reducing the internal pressure to below the preset pressure and thus permitting the slide valve 58 to be moved toward the valve seat 62 by the compression in the bellows spring 56 thereby closing the valve. The limited transverse and longitudinal movement of the valve seat insures a complete circumferential seating of the valve surfaces 64 and 66, and when utilizing hemispherical seating surfaces, such as illustrated in FIG. 3, further assurance of the seating is provided. Normal operations can then be resumed.

As previously mentioned, the improved pressure differential circulating valve 10 can be used for any purpose where it is desired to treat wells by circulating fluid from within the tubing string through the valve to the exterior of the tubing string. Advantageously, the pressure differential circulating valve can be located at any depth in a tubing string, above or below packers packing off the annular space between the tubing and the casing for treating by circulating fluids as indicated. The improved pressure differential circulating valve 10 simply opens at any predetermined, preset flow pressure and automatically closes when the pressure flow below the preset pressure.

Advantageously, the treating fluid can be directed to the desired place or places in the tubing 12 and casing 40 without the time, expense and downtime of the well when circulating in the annulus between the tubing 12 and the casing 40 or circulating down and back in the tubing.

Also, use of the improved pressure differential circulating valve avoids heating the casing, surface pipe, formation or causing damage to the cement bonding of the casing and substantially reduces the amount of hot oil required, or other treating fluid than with circulating hot oil or other treating fluid in the tubing or annulus.

One or more of the improved pressure differential valves 10 can be used in the tubing 12, they can be set at the same or different preset opening pressures, and, if desired, the improved pressure circulating valve 10 can be reversed and connected upside down to that shown in the drawing.

While the improved differential circulating valve has been described in connection with production of wells, it can also be used in drilling of wells, fishing and workover operations where it is desired to circulate fluid into a particular place in the well bore. It is only necessary to make the improved differential pressure circulating valve strong enough for the particular use and to fit into the drilling or workover string or pipe string and to adjust the compression in the bellows spring so that it will open at a desired preset pressure, such as above normal pump pressures for drilling fluids when drilling a well.

Accordingly, the pressure differential circulating valve is well suited and adapted to attain the objects and ends and has the advantages and features mentioned as well as others inherent therein.

While preferred embodiments of the improved pressure differential circulating valve have been shown and described for purposes of disclosure, changes can be made and equivalents can be substituted therein in accordance with the spirit of the invention as defined by the appended claims.

What is claimed is:

1. An improved pressure differential circulating valve for flow of fluid there through and out through the pressure differential circulating valve comprising, a tubular body having means at its ends for connection in and to form a portion of a string of pipe, the body having a passageway there through communicating with and forming a portion of the string of pipe passageway, a pair of spaced, facing annular shoulders extending outwardly of the body, a tubular slide valve slidably disposed about the body between the annular shoulders, seal means associated with the body and the tubular valve sleeve effective to provide a seal between the body and the tubular slide valve, an annular valve seat removably disposed about the body and engaging one of the annular shoulders, the valve seat being movable longitudinally and transversely of the tubular body, the annular valve seat having a valve seating surface, the annular valve seat having an inwardly facing annular groove and a downwardly facing annular groove, resilient seal means in the grooves engaging the tubular body and the one annular shoulder effective to permit limited transverse and longitudinal movement of the valve seat relative to and to provide a seal between the tubular body and the one annular shoulder, a mating annular valve surface adjacent one end of the slide valve effective to seat on and form a seal with the valve surface of the annular valve seat, the limited movement of the annular valve seat effective to provide complete alignment of the annular valve seat and the mating annular valve surface, ports disposed in the body in fluid communication with and closed by the valve surfaces, and spring means disposed about the tubular body and engaging the other annular shoulder and the other end of the slide valve yieldingly maintaining the slide valve in a position sealingly seating the annular valve surface of the sleeve valve against the valve surface of the annular valve seat thereby with the seal means closing the ports during normal flow pressures in the passageway in the tubular body but yieldable to predetermined flow pressure higher than the normal flow pressures, whereby during normal flow through the pipe string passage and the passageway in the tubular body, the slide valve is closed thereby closing the ports, and upon application of flow pressure in the passageways at least as high as the predetermined flow pressure, fluid unseats the annular valve surface of the slide valve from the annular valve surface of the valve seat and forces the slide valve away from the valve seat thereby permitting the flow of fluid from the passageway, through the ports in the tubular body and between the valve seating surfaces and out of the tubular body, the spring means moving the slide valve to seat its valve surface against the valve surface of the valve seat upon reduction of flow pressure below the predetermined flow pressure thereby sealing the passageway in the tubular body.

2. The improved pressure differential circulating valve of claim 1 where, the slide valve has a circumferentially extending manifold groove in fluid communication with the ports in the body.

3. The improved pressure differential circulating valve of claim 2 including, a circumferentially extending passageway extending from the manifold groove to the valve surfaces.

4. The improved pressure differential circulating valve of claim 1 where, the valve seating surfaces on the valve sleeve and on the valve seat are mating hemispherical surfaces.

5. The improved pressure differential circulating valve of claim 4 where, the mating hemispherical sealing surfaces are at an angle of about 45 degrees to the body.

6. The improved pressure differential circulating valve of claim 1 where, the spring means comprises a bellows compression spring.

7. An improved pressure differential circulating valve for use in a well bore for flow of fluid therein, the pressure differential circulating valve comprising, a tubular body having means at its end for connection in and to form a portion of a string of pipe having a passageway, the body having a passageway there through communicating with and forming a portion of the passageway of the string of pipe, a pair of spaced facing annular shoulders extending outwardly of the body, at least one of the shoulders being removable from the body, a tubular slide valve slidably disposed about the body between the annular shoulders, seal means associated with the body and the tubular valve sleeve effective to provide a seal between the body and the tubular slide valve, an annular valve seat having a valve seating surface removably disposed about the body engaging one of the annular shoulders, the annular valve seat having an inwardly facing annular groove and a downwardly facing annular groove, resilient seal means in the grooves engaging the tubular body and the one annular shoulder effective to permit limited transverse and longitudinal movement of the valve seat relative to and to provide a seal between the tubular body and the one annular shoulder, an annular valve surface adjacent one end of the slide valve effective to seat on and form a seal with the valve surface of the annular valve seat, the limited movement of the annular valve seat effective to provide complete alignment of the annular valve seat and the mating annular valve surface, ports disposed in the body permitting flow through the body, the slide valve having a circumferentially extending manifold groove in fluid communication with the ports in the body and a circumferentially extending passageway extending from the manifold groove to the valve surfaces thereby providing fluid communication from inside the body, through the ports to the valve surfaces, and spring means disposed about the tubular body and engaging the other annular shoulder and the other end of the slide valve yieldingly maintaining the slide valve in a position sealingly seating the annular valve surface of the sleeve valve against the valve surface of the annular seat thereby with the seal means closing the ports during normal flow pressures in the passageway in the tubular body but yieldable to predetermined flow pressure higher than the normal flow pressures, whereby during normal flow through the pipe string passage and the passageway in the tubular body, the slide valve is closed thereby closing the ports, and upon application of flow pressure in the passageways at least as high as the predetermined flow pressure, fluid in the passageways unseats the annular valve surface of the slide valve from the annular valve surface of the valve seat and forces the slide valve away from the valve seat thereby permitting the flow of the fluid from the passageway in the tubular body, through the ports, into the manifold and the circumferential passageway to between the valve seating surfaces thereby moving the valve seating surface on the sleeve valve away from the valve seat and permitting flow of the fluid out of the pressure differential circulating valve, the spring means moving the slide valve to seat its valve surface against the valve surface of the annular valve seat upon reduction of flow pressure below the predetermined flow pressure thereby sealing the passageway in the tubular body.

8. The improved pressure differential circulating valve of claim 7 where, the valve seating surfaces on the valve sleeve and on the valve seat are mating hemispherical surfaces.

9. The improved pressure differential circulating valve of claim 8 where, the mating hemispherical seating surfaces are an angle of about 45 degrees to the body.

10. The improved pressure differential circulating valve of claim 7 where, the spring means comprises a bellows compression spring.

11. An improved pressure differential circulating valve for flow of fluid there through and out through the pressure differential circulating valve comprising, a tubular body having means at its end for connection in and to form a portion of a string of pipe, the body having a passageway there through communicating with and forming a portion of the string of pipe passageway, a pair of spaced, facing annular shoulders extending outwardly of the body, a tubular slide valve slidably disposed about the body between the annular shoulders, seal means associated with the body and the tubular valve sleeve effective to provide a seal between the body and the tubular slide valve, an annular valve seat disposed about the body and engaging one of the annular shoulders, the annular valve seat having a valve seating surface, seal means associated with the annular valve seat effective to provide a seal between the body and the one annular shoulder, a mating annular valve surface adjacent one end of the slide valve effective to seat on and form a seal with the valve surface of the annular valve seat, port disposed in the body in fluid communication with and closed by the valve surfaces, the slide valve having a circumferentially-extending manifold groove in fluid communication with the ports in the body and a tapered circumferentially-extending passage in fluid communication with the manifold groove and the valve seating surfaces effective to provide instantaneous snap action opening of the valve sleeve by fluid flowing through the ports, and spring means disposed about the tubular body and engaging the other annular shoulder and the other end of the slide valve yieldingly maintaining the slide valve in a position sealingly seating the annular valve surface of the sleeve valve against the valve surface of the annular valve seat thereby with the seal means closing the ports during normal flow pressures in the passageway in the tubular body but yieldable to predetermined flow pressure higher than the normal flow pressures, whereby during normal flow through the pipe string passage and the passageway in the tubular body, the slide valve is closed thereby closing the ports, and upon application of flow pressure in the passageways at least as high as the predetermined flow pressure, fluid unseats the annular valve surface of the slide valve from the annular valve surface of the valve seat and forces the slide valve away from the valve seat thereby permitting the flow of fluid from the passageway, through the ports in the tubular body, the manifold groove in the slide valve and between the valve seating surfaces and out of the tubular body.

* * * * *